US005549512A

United States Patent [19]

Sinclair et al.

[11] Patent Number: 5,549,512

[45] Date of Patent: Aug. 27, 1996

[54] MINIENVIRONMENT FOR HAZARDOUS PROCESS TOOLS

[75] Inventors: James D. Sinclair, Summit; Constance A. Jankoski, Branchburg, both of N.J.

[73] Assignee: Lucent Technologies Inc., Murray Hill, N.J.

[21] Appl. No.: 346,806

[22] Filed: Nov. 30, 1994

[51] Int. Cl.[6] ..... B08B 15/02

[52] U.S. Cl. ..... 454/58; 454/57

[58] Field of Search ..... 454/56, 57, 58, 454/60, 187

[56] References Cited

U.S. PATENT DOCUMENTS

| | | | |
|---|---|---|---|
| 3,895,570 | 7/1975 | Eagleson, Jr. | 454/57 |
| 4,637,301 | 1/1987 | Shields | 454/57 |
| 4,682,927 | 7/1987 | Southworth et al. | 414/217 |
| 4,880,581 | 11/1989 | Dastoli et al. | 264/39 |
| 4,936,922 | 6/1990 | Cherry | 134/22.18 |
| 4,976,815 | 12/1990 | Hiratsuka et al. | 454/187 X |
| 5,029,518 | 7/1991 | Austin . | |
| 5,255,710 | 10/1993 | Palmer | 137/501 |
| 5,259,812 | 11/1993 | Kleinsek | 454/59 |

FOREIGN PATENT DOCUMENTS

| | | | |
|---|---|---|---|
| 2485698 | 12/1981 | France | 454/58 |
| 21627 | 7/1970 | Japan | 454/57 |
| 18134 | 5/1980 | Japan | 454/60 |
| 147249 | 7/1987 | Japan | 454/187 |
| 39551 | 2/1992 | Japan | 454/187 |

OTHER PUBLICATIONS

*Abstracts of Japan,* May 1985, Hitachi KK.

*Primary Examiner*—Harold Joyce

[57] ABSTRACT

A method and apparatus for providing a clean working area within an enclosure while simultaneously permitting open access to the working area from outside and also preventing any toxic substances from escaping the enclosure to contaminate a worker area. A higher pressure region within the enclosure near the aperture of the enclosure prevents dirt from entering and toxic materials from escaping.

36 Claims, 3 Drawing Sheets

MINIENVIRONMENT FOR HAZARDOUS PROCESS TOOLS

BACKGROUND OF THE INVENTION

1. Field of the Invention

This invention relates to a method and apparatus for creating a clean working area while protecting workers and the environment from being contaminated by hazardous products used or created therein, and in particular to the protection of a wet chemical bench.

2. Description of Related Art

Operations are often performed in clean hoods in industries such as electronics or pharmaceuticals where air is filtered within a chamber and passed over a work area. This is done under positive pressure with respect to the pressure outside the chamber, or else dirt particles would be sucked into the work area when it is necessary to enter or remove articles or when an operator needs to work within the chamber. These hoods are cheaper to install and operate than in maintaining a whole laboratory in "Class 1" condition, where the class rating represents the number of particles greater than 0.5 micrometers per cubic foot. In normal laboratories this number is at least 100,000.

U.S. Pat. No. 5,259,812 (D. A. Kleinsek) is directed to a laboratory room and an anteroom within a chamber, separated by a dividing wall having a door. Both rooms form a positive pressure entry system which prevents outside air from entering the clean room. A containment center within a clean room is also described which employs conventional iris ports shielded with two layers rubber and a double door transition box to remove samples without allowing external air from entering into the containment center.

U.S. Pat. No. 5,255,710 (D. Palmer) teaches two stage control of air flow to an environment from a pressure source wherein a piston defines an aperture through which air may flow from the pressure source and a plenum so as to variably constrict the conduit, the weight of the piston tending to move it in a direction to lessen the piston's impedance to air flow. An adjustable valve, located between the piston and the environment, further impedes the flow of air. A gate may be rigidly attached to the piston so that changes in the pressure source's strength do not affect the plenum pressure.

U.S. Pat. No. 5,029,518 (F. X. Austin) describes modular wall sections which are assembled on site to construct a wall of a clean room. Each section serves as an air return and directs air from the room upward within the section to a negative pressure plenum within the ceiling of the clean room.

U.S. Pat. No. 4,880,581 (F. R. Dastoli et al.) describes the placement of a shroud over a portion of a device, and U.S. Pat. No. 4,682,927 (P. R. Southworth et al.) discloses the use of a conveyer system to move cassettes of semiconductor wafers between clean rooms.

With increased regulatory requirements for the protection of workers and the environment there remains a need to protect the work from dust while providing access to the work area and completely removing toxic chemicals or pathogens used or generated within the work area. A means is needed to deal with the apparently contradicting requirements of positive pressure in the work area to prevent dust ingress but negative pressure to prevent escape of toxic substances. Such equipment should also not require continuous monitoring of flow conditions.

3. Summary of the Invention

The present invention relates to apparatus and a method to provide access for parts or an operator's hands into a clean area while ensuring that toxic contaminants within the work area do not escape into the room. This is accomplished by creating an isolation region of pressure immediately behind the entrance to the chamber that is higher than the pressure outside the chamber. This keeps dirt from entering, but alone, it would also expel toxic materials. Therefore, another region of pressure is maintained within the chamber, a working pressure, which is less than the isolation pressure near the entrance to the chamber. This pressure differential prevents toxic contaminants from escaping.

In one embodiment of the invention, an uncontaminated gas is supplied to one extremity of an enclosure at a supply pressure, and an isolation pressure is maintained inside the enclosure near an aperture to the enclosure to create an isolation region. A working pressure is maintained behind the isolation region to create a working region. The enclosure is evacuated by maintaining another extremity at an exhaust pressure. The aforementioned pressures are maintained in descending order to create a pressure gradient and flow to remove contaminants. The isolation pressure is also maintained at a pressure higher than that outside the chamber. A fraction of the air in the isolation region escapes through the aperture to keep particles out, and a fraction of it also flows into the working region to keep contaminants within the chamber. Placing a baffle before the isolation region and the working region creates the desired pressure differential. The baffle may provide no impedance to flow over the isolation region, or the impedance may vary across the depth of the baffle.

In another embodiment of the invention, a vane intercepts a portion of the air flowing within the chamber to create the required pressure inequality to keep dirt out of the chamber and to keep toxic contaminants within it. The vane may be fixed in position or can be made to vary in position to optimize the flow for each installation.

The advantage to creating the isolation region of pressure which is higher than the outside pressure and the working pressure in most of the chamber is that toxic contaminants within the chamber are prevented from escaping through the aperture and that dirt particles from the outside are prevented from destroying the work, while access to the chamber is provided for the entry and removal of articles or for human intervention. Once the pressure differentials are established by the use of baffles or vanes, no further calibration is needed except to maintain sufficient flow to keep the isolation pressure above the outside pressure.

These and other features and advantages of the invention will be better understood with consideration of the following detailed description of the preferred embodiments taken in conjunction with the accompanying drawings.

DETAILED DESCRIPTION OF THE PREFERRED EMBODIMENTS

Figure 1:
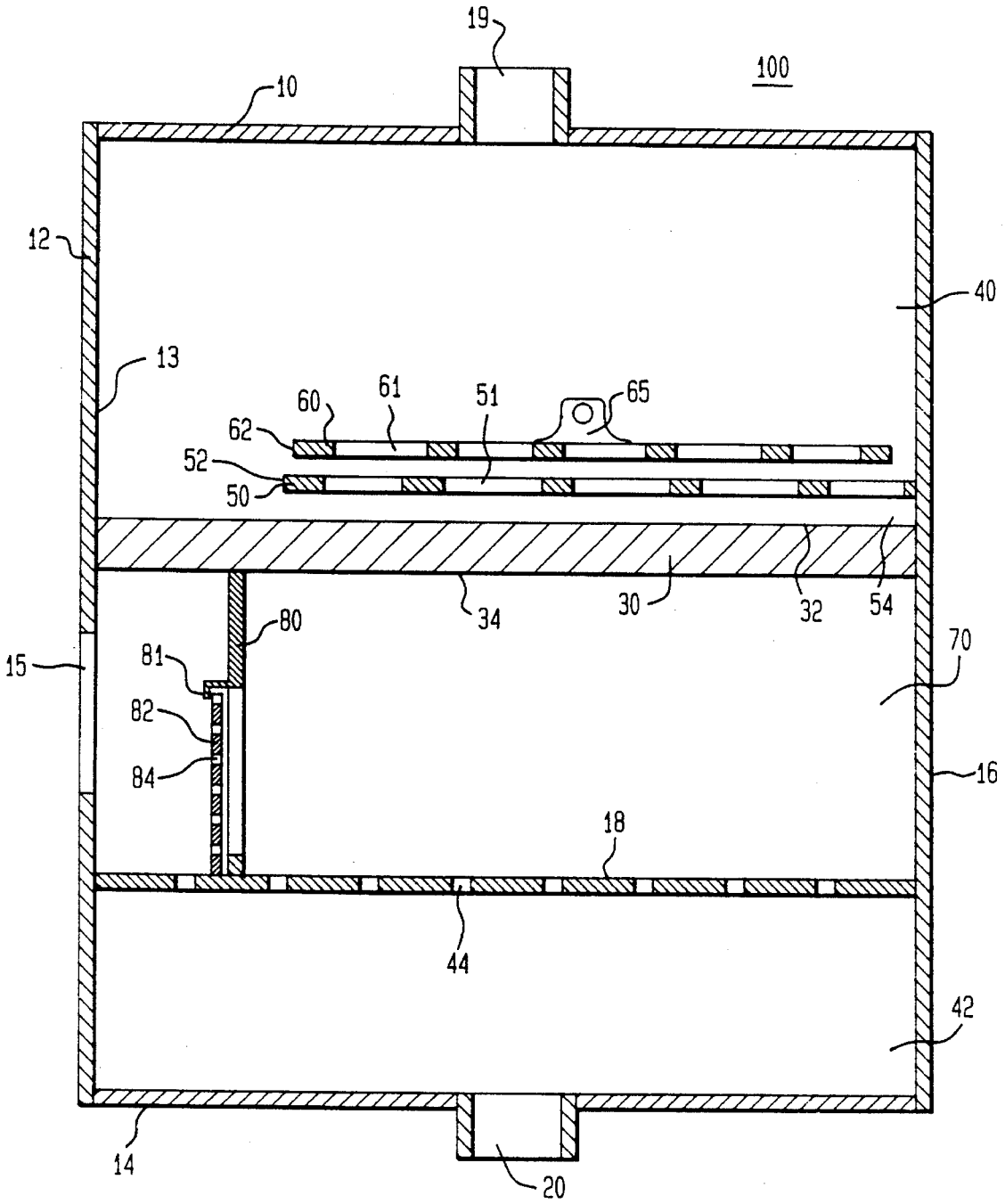
FIG. 1, is a sectional view of apparatus in accordance with one embodiment of the invention.

Referring now to FIG. 1, there is shown apparatus 100 in accordance with one embodiment of the invention comprising top 10, front 12, bottom 14, rear 16, work surface 18, inlet 19, and exhaust 20. The top, front, bottom and rear form a chamber with sides, not shown, which is air tight except for the inlet and exhaust and aperture 15 which is defined by front 12. Filter 30 is above the work surface and defines supply plenum 40 together with the sides, top, and upper portions of front 12 and rear 16. The dimensions of supply plenum 40 are not critical except that the volume of it must be sufficient to ensure a relatively constant supply pressure in the area above filter 30.

A series of exhaust holes 44 penetrate work surface 18, permitting air flowing down from the filter to enter exhaust plenum 42 and to be removed via exhaust 20.

Immediately above filter 30 is fixed plate 50 which defines a series of flow holes 51 which are arranged so that the area of the flow holes exceeds 50% of the area of plate 50. Fixed plate 50 is mounted to the sides of the chamber. Slideably mounted to the sides of the chamber is plate 60 which defines a series of flow holes 61 which are arranged so that the area of the flow holes exceeds 50% of the area of plate 60. Edges 52 and 62 of fixed plate 50 and plate 60, respectively, are spaced apart from the inner surface 13 of front 12 by a distance which may be 5% to 30% of the depth of filter 30 which is beneath fixed plate 50. The distance between upper surface 32 and lower surface 54 of the fixed plate is typically from 0.2 to 1.0 inches. Inner wall 80 is mounted across the chamber between lower surface 34 of filter 30 and working surface 18. Guide 81 mounted to inner wall 80 constrains sliding door 82 which defines a series of holes 84. These holes minimize pressure disruptions as the sliding door is opened to remove articles from the working chamber. The distance between inner wall 80 and inner surface 13 may be from 0.5 inches to 6.0 inches The purpose of the two plate arrangement described above is to provide an adjustable pressure drop in the air flowing into the filter below the plate. Air in supply plenum 40 which is between edges 52 and 62 and inner surface 13 is unimpeded as it enters the filter. The result upon filtered air leaving the lower surface of the filter is that a region of higher pressure is created in the front portion of working chamber 70 beneath the gap defined by the edges of the plates and inner surface 13 than in the region below the plates. This high pressure creates an isolation region between most of the chamber and the outside (dirty) atmosphere. There will be some flow of filtered air from the isolation region through aperture 15 to the outside. This flow keeps particles from entering the chamber. There will also be some flow to the interior of the chamber as the filtered air from the gap between surface 13 and edge 52 flows downward to exhaust holes 44. This component of the flow keeps toxic fumes or particles from escaping. Toxic materials generated within the chamber are removed through exhaust holes 44, exhaust plenum 42, and exhaust 20 where they are directed for treatment and disposal. The size, arrangement, and location of the exhaust holes is not critical and will depend on the particular process. For example, the exhaust plenum could be located in front of rear 16.

The highest pressure in apparatus 100 is the supply pressure, Ps, in supply plenum 40. There is a pressure drop in passing through the filter for air supplying the isolation space. The pressure in the isolation space is Pi, which must exceed the pressure outside the chamber, Po, or Pi>Po. The lowest pressure is the exhaust pressure, Px. The required inequality is: Ps>Pi>Pw>Px, where Pw is the pressure in the chamber directly under the filter and beneath plates 50 and 60. Within these relationships Pw may be greater than, equal to, or less than Po. In a typical chamber Pw is from 0.0005 to 0.01 inches of water greater than Po.

The method to practice the invention involves setting the pressure inequalities set forth above for each installation. Each filter type has a characteristic pressure drop, and the exhaust hole size, arrangement, and location may vary. The supply and exhaust pressures will also vary depending upon the location of the minienvironment in the building. Providing a baffle, such as the plate arrangement described, or a fixed plate by itself, will ensure the pressure inequality Pi>Pw which prevents toxic materials from escaping.

Figure 2:
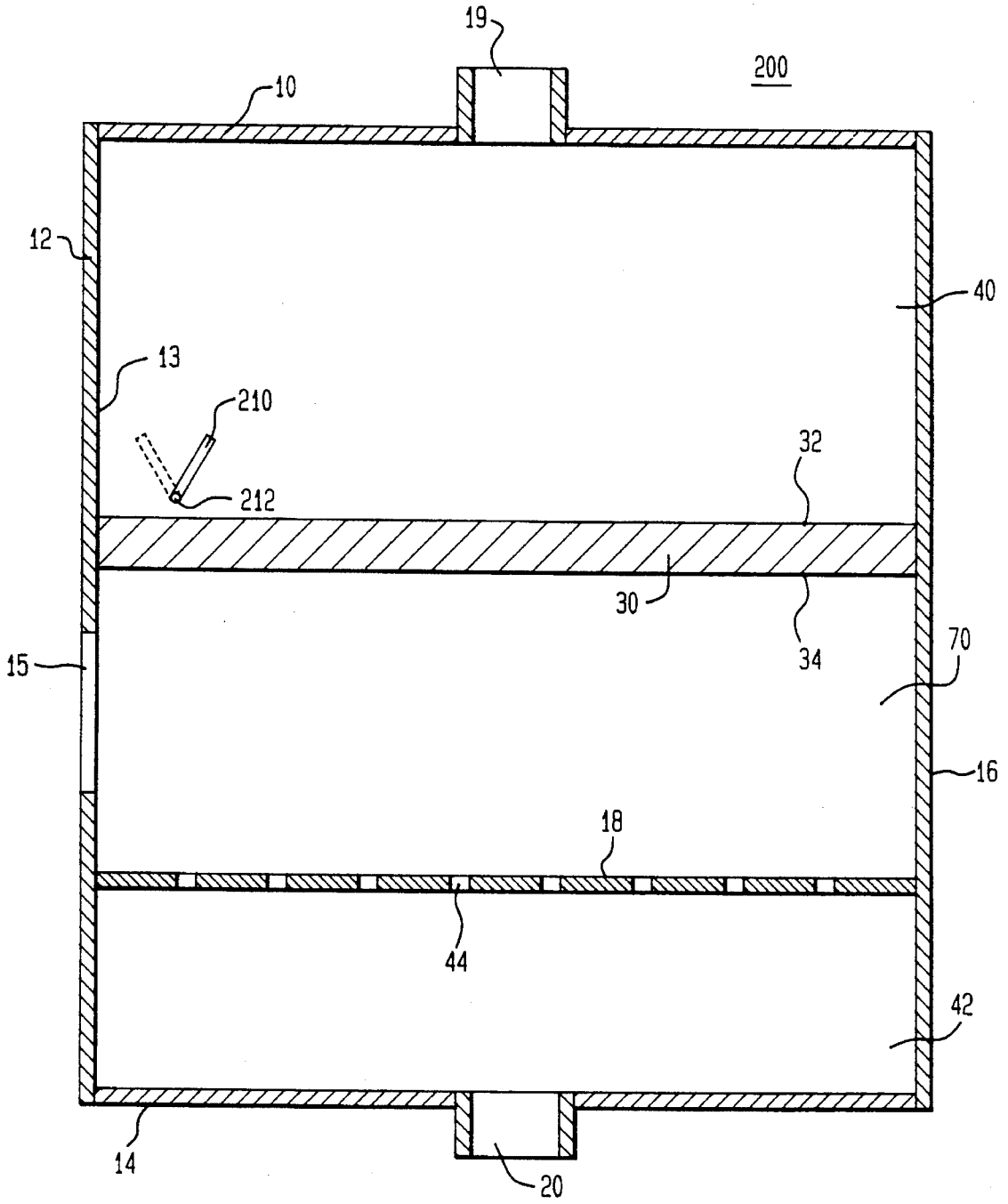
FIG. 2 is a sectional view of apparatus in accordance with another embodiment of the invention.

Referring now to FIG. 2, there is shown apparatus 200 in accordance with another embodiment of the same invention wherein elements of apparatus 200 which are the same as those in apparatus 100 have the same reference number.

A vane 210 is mounted within supply plenum 40 in a direction approximately parallel to front 12. Vane 210 is attached to pivot 212, at least one end of which penetrates one of the sides of the enclosure (not shown) so that the angle between the vane and the flow direction may be varied from minus 45 degrees (shown dotted in FIG. 2) to plus 45 degrees from vertical (shown solid in FIG. 2). The vane is located nearer the front of the chamber than the rear. Pivot 212 may be separated from inner surface 13 from 2% to 30% of the distance between the front and the rear, and may extend along its minor axis away from pivot 212 from 10% to 90% of the distance between upper surface 32 and top 10. The vane is also located above upper surface 32 of filter 30 by 0.2 to 1.0 inches.

The purpose of the vane is to provide the same pressure differential in the air entering the filter as that in the discussion of apparatus 100. The effect is also to create an isolation space and the same pressure inequalities as before.

Figure 3:
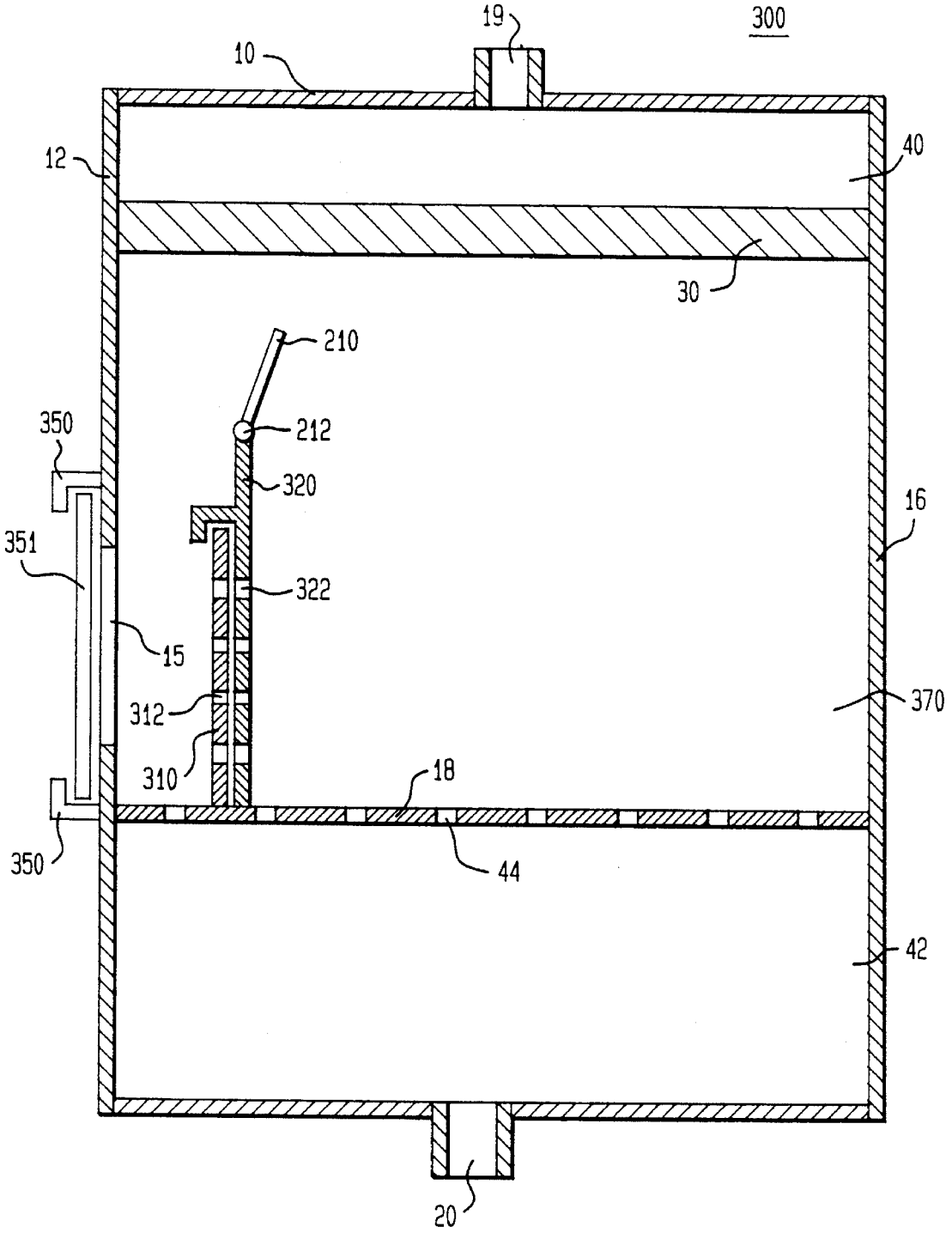
FIG. 3 is a sectional view of apparatus for still another embodiment of the invention.

Referring now to FIG. 3, there is shown apparatus 300 which is in accordance with still another embodiment of the invention wherein the elements with the same function as in the previous figures have same reference numbers.

Apparatus 300 shows a vane 210 mounted to pivot 212. Sliding door 310 defines a series of holes 312 and is slideably mounted to rest upon work surface 18. Inner wall 320 is fixed between pivot 212 and the work surface and also defines a series of holes 322. The purpose of the holes is to minimize any pressure disruptions as sliding door 310 is opened to remove articles from within working chamber 370. Guides 350 constrain sliding outer door 351 which covers aperture 15.

The pressure inequalities and their cooperation to keep toxic contaminants within the chamber and dirt particles outside the chamber, which were given in the discussion of apparatus 100 and apparatus 200, are repeated here.

The previously described versions of the invention have many advantages, including the ability to simultaneously protect the work from outside dirt, to prevent toxic contaminants from escaping, and to provide open access to the chamber in a simple and maintenance free installation.

Changes and modifications in the specifically described embodiments can be carried out without departing from the scope of the invention. In particular, the baffle in apparatus 100 and the vane in apparatus 200 may be located below the filter. The baffle, the vane, and the inner wall may be used separately or in combination in various embodiments. The sliding door of apparatus 100 in FIG. 1 may be incorporated into apparatus 200 in FIG. 2 and the sliding door attached to front surface 12 of apparatus 300 in FIG. 3 may be incorporated into apparatus 100 in FIG. 1 and apparatus 200 in FIG. 2.

We claim:

1. A method of preventing contaminants from escaping to a worker environment from an enclosure having two extremities, wherein one extremity includes an intake and the other extremity includes an exhaust, and an aperture therebetween, comprising the steps of:

supplying an uncontaminated gas to the enclosure at a supply pressure in a supply region at one extremity of the enclosure;

maintaining an isolation pressure within the enclosure in a region nearest the aperture and between the extremities for creating an isolation region adjacent an environment outside said enclosure;

maintaining a working pressure within the enclosure in a region defined by the two extremities and the isolation region, for creating a working region within which contaminants are generated;

maintaining an exhaust pressure in an exhaust region at the other end of the enclosure proximate said other extremity;

maintaining these pressure in the following descending order—supply pressure, isolation pressure, working pressure, and exhaust pressure for creating a pressure gradient and flow throughout the enclosure, said supply pressure being greater than said exhaust pressure, and said isolation pressure being at a pressure greater than outside said enclosure; and removing gas and contaminants at the other extremity.

2. The method of claim 1 further comprising maintaining the isolation pressure at a level higher than the pressure of the atmosphere outside the enclosure.

3. The method of claim 1 wherein maintaining a pressure differential between the isolation pressure and the working pressure further comprises placing a baffle in the flow before the isolation region and the working region.

4. The method of claim 3 further comprising varying the impedance to flow of the baffle in a direction which is approximately perpendicular to the flow.

5. A method of preventing dirt particles from entering into an enclosure having two extremities and an aperture therebetween, comprising the steps of:

supplying a gas to the enclosure at a supply pressure in a supply region at one extremity of the enclosure, said supply region being defined within said enclosure by a filter;

maintaining a working pressure within the enclosure in a region defined by the two extremities and an isolation region adjacent an outside atmosphere, for creating a working region which is to be kept free of particles, said working region including pressure regulation means proximate thereto for maintaining said working pressure below an isolation pressure in said isolation region;

maintaining an exhaust pressure at the other end of the enclosure;

maintaining these pressure in the following descending order—supply pressure, isolation pressure, and exhaust pressure for creating a pressure gradient and flow throughout the enclosure;

maintaining the isolation pressure at a level higher than the pressure of the atmosphere outside the enclosure; and removing gas at the other extremity.

6. The method of claim 5 wherein maintaining a pressure differential between the isolation pressure and the working pressure further comprises placing a baffle in the flow before the isolation region and the working region, said baffle acting as said pressure regulation means.

7. The method of claim 5, wherein said pressure regulation means includes a vane, wherein maintaining a pressure differential between the isolation pressure and the working pressure further comprises placing said vane in the flow before the isolation region and the working region.

8. A method of preventing dirt particles from entering into an enclosure and for preventing contaminants therein from escaping to a worker environment, the enclosure having two extremities and an aperture therebetween, comprising the steps of:

supplying a gas to the enclosure at a supply pressure at one extremity of the enclosure;

maintaining an isolation pressure within the enclosure in a region nearest the aperture and between the extremities for creating an isolation region;

maintaining a working pressure within the enclosure in a region defined by the two extremities and the isolation region, for creating a working region which is to be kept free of particles;

maintaining an exhaust pressure at the other end of the enclosure;

maintaining these pressures in the following descending order—supply pressure, isolation pressure, working pressure, and exhaust pressure for creating a pressure gradient throughout the enclosure;

maintaining the isolation pressure at a level higher than the pressure of the atmosphere outside the enclosure; and removing gas and toxic contaminants at the other extremity.

9. The method of claim 8 wherein maintaining a pressure differential between the isolation pressure and the working pressure further comprises placing a baffle in the flow before the isolation region and the working region.

10. The method of claim 8 further comprising varying the impedance to flow of the baffle in a direction which is approximately perpendicular to the flow.

11. Apparatus for preventing dirt particles from entering into an enclosure and for preventing contaminants therein from escaping to a worker environment, comprising:

an enclosure having two extremities including an intake and an exhaust and an aperture therebetween, said enclosure including an inner wall, which together with a work surface, a rear wall, two sides, and a lower surface of a filter defines a working region;

an isolation region adjacent said working region, said isolation region being defined by said work surface, said lower surface of said filter, said two sides and said aperture; and pressure regulation means for maintaining a pressure in said isolation region at a pressure greater than in said working region, said pressure in solid isolation region also being greater than outside said enclosure, wherein the pressure differential created acts to prevent contaminants from escaping said working region and outside contaminants from entering said working region.

12. The apparatus of claim 11, wherein said pressure regulating means includes a baffle which provides an impedance to a gas flow in one region of the enclosure which is greater than the impedance provided to the flow in another region of the enclosure, wherein the baffle spans one region of the enclosure and permits unimpeded flow in another region of the enclosure.

13. The apparatus of claim 11 wherein said pressure regulating means includes a vane which provides an impedance to a gas flow in one region of the enclosure which is greater than the impedance provided to the flow in another region of the enclosure.

14. The apparatus of claim 12 wherein the baffle comprises a first plate defining a first set of flow holes and a second plate defining a second set of flow holes, the second plate being slideably mounted with respect to the first plate.

15. The apparatus of claim 12 wherein the baffle provides less impedance to the flow in one region of the enclosure which is located nearer the aperture than another region where the baffle provides a greater impedance to flow.

16. The apparatus of claim 11 further comprising a sliding door mounted to the inner wall whereby articles may be removed from the working chamber through the inner wall.

17. The apparatus of claim 16 further comprising a series of holes defined by the sliding door.

18. The apparatus of claim 11, wherein said pressure regulation means includes, a vane, mounted within the enclosure between a first extremity and the aperture, which intercepts a portion of a gas flowing from the first extremity to a second extremity.

19. An enclosure for preventing dirt particles from entering the enclosure and for preventing contaminants therein from escaping to a worker environment comprising:

a top defining an inlet for a gas;

a bottom defining an exhaust from the enclosure;

two sides, spaced apart, connecting the top and the bottom;

a rear connecting the top, bottom, and two sides;

a front, connecting the top, bottom, and two sides, defining an aperture therein;

a filter, connected to the two sides and the rear, being located above the aperture, wherein a supply region is defined above said filter and a working region is defined below said filter between a work surface contained within, said supply region and said working region being maintained at a supply pressure $P_s$ and a working pressure $P_w$, respectively;

an isolation region adjacent said working region and defined by said filter, said work surface and said front defining said aperture, said isolation region being maintained at an isolation pressure $P_i$ greater than said working pressure;

an exhaust region defined between said working surface and said bottom and being maintained at an exhaust pressure $P_x$; and pressure regulating means adapted to maintain pressure in said enclosure according to the relationship $p_s>p_i>p_w>p_x$, wherein a pressure outside said enclosure is less than $P_i$, thereby creating a pressure differential to prevent contaminants from escaping said working region and outside contaminants from entering said working region.

20. The enclosure of claim 19, including an inner wall, located behind the aperture, which supports a sliding door, and wherein said pressure regulation means is a baffle, located above the aperture, being connected to the two sides and the rear, having an edge defining a gap between the baffle and an inner surface of the front.

21. The apparatus of claim 18 wherein the aperture is defined by a front of the enclosure and the vane is located nearer to the front than to an opposing rear of the enclosure.

22. The apparatus of claim 18 wherein one axis of the vane is approximately perpendicular to an axis between the extremities.

23. The apparatus of claim 18 wherein the vane causes a pressure differential to exist within the enclosure between the vane and the second extremity.

24. The apparatus of claim 18 wherein an angle between one axis of the vane and an axis between the extremities is variable.

25. The apparatus of claim 18 wherein the angle may vary from minus 45 degrees to plus 45 degrees.

26. The enclosure of claim 19, wherein said pressure regulation means includes a vane, located above the aperture and nearer to the aperture than to an opposing rear, being connected to the two sides, having an axis defining an angle between the vane and an axis between the top and the bottom.

27. The enclosure of 26 wherein the angle may be varied to control a pressure differential within the enclosure between the vane and the bottom.

28. The apparatus of claim 26 further comprising an inner wall, within the enclosure, which together with a work surface, a rear wall, two sides, and a lower surface of a filter defines a working region.

29. The apparatus of claim 28 further comprising a sliding door mounted to the inner wall whereby articles may be removed from the working region through the inner wall.

30. The apparatus of claim 29 further comprising a series of holes defined by the sliding door.

31. The enclosure of claim 19, wherein said pressure regulation means includes, a vane, located above the aperture and nearer to the aperture than to an opposing rear, being connected to the two sides, having an axis defining an angle between the vane and an axis between the top and the bottom, and an inner wall, within the enclosure, which together with a work surface, a rear wall, two sides, and a lower surface of a filter defines a working region.

32. The apparatus of claim 31 further comprising a sliding door mounted to the inner wall whereby articles may be removed from the working chamber through the inner wall.

33. The apparatus of claim 32 further comprising a series of holes defined by the sliding door.

34. The enclosure of claim 31 further comprising an outer sliding door covering the aperture.

35. Apparatus for preventing dirt particles from entering into an enclosure and for preventing contaminants therein from escaping to a worker environment, comprising:

an enclosure having two extremities and an aperture therebetween, further including an inner wall, within the enclosure, which together with a work surface, a rear wall, two sides, and a lower surface of a filter defines a working region;

a baffle which provides an impedance to a gas flow in one region of the enclosure which is greater than the impedance provided to the flow in another region of the enclosure; and a sliding door mounted to the inner wall whereby articles may be removed from the working chamber through the inner wall, and a series of holes defined by the sliding door.

36. The enclosure of claim 20, wherein the baffle includes a fixed and a movable plate, each defining a series of flow holes, cooperating to vary the impedance to the flow.

* * * * *